US010077924B2

(12) United States Patent
Takayama et al.

(10) Patent No.: US 10,077,924 B2
(45) Date of Patent: Sep. 18, 2018

(54) BINARY REFRIGERATION APPARATUS

(71) Applicant: Mitsubishi Electric Corporation, Tokyo (JP)

(72) Inventors: Keisuke Takayama, Tokyo (JP); Tomotaka Ishikawa, Tokyo (JP); Takeshi Sugimoto, Tokyo (JP); Tetsuya Yamashita, Tokyo (JP); Takashi Ikeda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 284 days.

(21) Appl. No.: 14/416,077

(22) PCT Filed: Aug. 5, 2013

(86) PCT No.: PCT/JP2013/071136
§ 371 (c)(1),
(2) Date: Jan. 21, 2015

(87) PCT Pub. No.: WO2014/024838
PCT Pub. Date: Feb. 13, 2014

(65) Prior Publication Data

US 2015/0176866 A1 Jun. 25, 2015

(30) Foreign Application Priority Data

Aug. 6, 2012 (JP) ..... 2012-173771

(51) Int. Cl.
*F25D 21/06* (2006.01)
*F25B 7/00* (2006.01)
(Continued)

(52) U.S. Cl.
CPC ..... *F25B 7/00* (2013.01); *F25B 5/04* (2013.01); *F25B 9/008* (2013.01); *F25B 47/022* (2013.01);
(Continued)

(58) Field of Classification Search
CPC .... F25B 7/00; F25B 5/04; F25B 49/02; F25B 9/008; F25B 47/022; F25B 2400/0409;
(Continued)

(56) References Cited

U.S. PATENT DOCUMENTS 2,977,773 A * 4/1961 De Kanter ..... F25B 13/00 62/149
3,350,898 A * 11/1967 Harnish ..... F25B 13/00 62/197
(Continued)

FOREIGN PATENT DOCUMENTS

CA 2868441 A1 * 12/2012 ..... F25B 9/008
JP 02-004167 A 1/1990
(Continued)

OTHER PUBLICATIONS

Tomczyk, J. (May 2, 2005). Refrigerant Pressures, States, and Conditions. Retrieved Jan. 5, 2017, from http://www.achrnews.com/articles/94025-refrigerant-pressures-states-and-conditions Attached herein as "The_News_reference".*
(Continued)

*Primary Examiner* — Christopher R Zerphey
*Assistant Examiner* — Miguel A Diaz
(74) *Attorney, Agent, or Firm* — Posz Law Group, PLC

(57) ABSTRACT

A two-stage refrigeration apparatus includes a high-stage refrigeration cycle including a high-stage-side refrigerant circuit including a high-stage-side compressor, high-stage-side condenser, high-stage-side expansion valve, and high-stage-side evaporator connected by pipes, a low-stage refrigeration cycle including a low-stage-side refrigerant circuit including a low-stage-side compressor, low-stage-side condenser, low-stage-side receiver, low-stage-side expansion valve, and low-stage-side evaporator connected by pipes, a cascade condenser including the high-stage-side evaporator
(Continued)

and low-stage-side condenser, a receiver heat exchanging portion configured to cool the low-stage-side receiver, and a high-stage refrigeration cycle controller configured to perform controlling so as to activate the high-stage-side compressor when estimating a low-stage-side refrigerant will reach a supercritical state while the low-stage-side compressor is defrosted on the basis of the pressure of the low-stage-side refrigerant.

8 Claims, 7 Drawing Sheets

(51) Int. Cl.

| | |
|---|---|
| ***F25B 5/04*** | (2006.01) |
| ***F25B 9/00*** | (2006.01) |
| ***F25B 47/02*** | (2006.01) |
| ***F25B 49/02*** | (2006.01) |
| ***F25D 21/00*** | (2006.01) |

(52) U.S. Cl.
CPC ..... *F25B 49/02* (2013.01); *F25D 21/002* (2013.01); *F25B 2309/061* (2013.01); *F25B 2400/0403* (2013.01); *F25B 2400/0409* (2013.01); *F25B 2400/0415* (2013.01); *F25B 2400/16* (2013.01); *F25B 2600/2501* (2013.01); *F25B 2700/1931* (2013.01); *F25B 2700/2104* (2013.01); *F25B 2700/2106* (2013.01); *F25B 2700/2108* (2013.01)

(58) Field of Classification Search
CPC ..... F25B 2400/0415; F25B 2400/0403; F25B 2600/2501; F25B 2700/1931; F25B 2700/2104; F25B 2700/2106; F25B 2309/061; F25B 2400/16; F25B 2700/2108; F25B 2347/02; F25D 21/002
See application file for complete search history.

(56) References Cited

U.S. PATENT DOCUMENTS 4,012,921 A * 3/1977 Willitts ..... F25B 47/022 62/151
4,087,987 A * 5/1978 Schumacher ..... F25D 21/002 62/174
4,149,389 A * 4/1979 Hayes ..... F25B 7/00 62/114
4,744,224 A * 5/1988 Erickson ..... F24J 2/1047 62/235.1
6,237,351 B1 * 5/2001 Itoh ..... B60H 1/00921 62/113
6,286,322 B1 * 9/2001 Vogel ..... F25B 47/025 62/278
6,324,856 B1 * 12/2001 Weng ..... F25B 7/00 62/175
7,900,467 B2 * 3/2011 Allen ..... F25B 39/02 165/140
8,011,201 B2 * 9/2011 Brown ..... F25B 7/00 62/298
9,410,727 B1 * 8/2016 Boyko ..... F25B 47/006
2004/0007013 A1 * 1/2004 Takeuchi ..... F04F 5/461 62/500
2004/0250556 A1 * 12/2004 Sienel ..... F25B 9/008 62/88
2005/0257564 A1 * 11/2005 Wightman ..... F25B 41/04 62/510
2006/0080989 A1 * 4/2006 Aoki ..... F25B 40/00 62/324.4
2006/0112713 A1 * 6/2006 Chang ..... F25B 13/00 62/324.1
2007/0137238 A1 * 6/2007 Hu ..... F25B 5/02 62/277
2009/0031737 A1 * 2/2009 Ueno ..... F25B 13/00 62/151
2009/0260389 A1 * 10/2009 Dube ..... C09K 5/041 62/430
2010/0031697 A1 * 2/2010 Hinde ..... F25B 7/00 62/498
2010/0192622 A1 * 8/2010 Oh ..... F25D 11/022 62/498
2012/0186284 A1 * 7/2012 Choi ..... F25B 7/00 62/115
2012/0266621 A1 * 10/2012 Yokohara ..... F25B 47/022 62/155
2013/0139528 A1 * 6/2013 Katayama ..... B60H 1/00921 62/81
2014/0013790 A1 * 1/2014 Asari ..... F25B 1/00 62/335
2014/0352343 A1 * 12/2014 Hinde ..... F25B 1/10 62/277
2015/0191182 A1 * 7/2015 Abou Eid ..... B61D 27/0018 62/80
2015/0316305 A1 * 11/2015 Pendlebury ..... F25B 9/006 62/115
2017/0108247 A1 * 4/2017 Sata ..... F25B 49/02

FOREIGN PATENT DOCUMENTS

JP 2003-004321 A 1/2003
JP 2003-214731 A 7/2003
JP 2004-190916 A 7/2004
JP 2004-190917 A 7/2004
JP 2012-087978 A 5/2012
JP 2012-093054 A 5/2012
JP 2012087978 A * 5/2012
JP 2012-112617 A 6/2012

OTHER PUBLICATIONS

Machine Translation of Ishikawa et al., JP 2012087978 A, obtained from "worldwide.espacenet.com".*
International Search Report of the International Searching Authority dated Oct. 29, 2013 for the corresponding international application No. PCT/JP20123/071136 (and English translation).
Office Action dated Nov. 5, 2013 in corresponding JP application No. 2012-173771 (and English translation).

* cited by examiner

REFRIGERANT FLOW IN HIGH-STAGE REFRIGERATION CYCLE
REFRIGERANT FLOW IN LOW-STAGE REFRIGERATION CYCLE

BINARY REFRIGERATION APPARATUS

CROSS REFERENCE TO RELATED APPLICATION

This application is a U.S. national stage application of International Application No. PCT/JP2013/071136 filed on Aug. 5, 2013, and is based on PCT/JP2012/173771 filed on Aug. 6, 2012, the contents of which are incorporated herein by reference.

TECHNICAL FIELD

The present invention relates to a two-stage refrigeration apparatus. In particular, it relates to a process for defrosting in a low-stage refrigeration cycle device.

BACKGROUND ART

As an apparatus for performing cooling in a low-temperature range of minus several tens of degrees, a two-stage refrigeration apparatus including a high-stage refrigeration cycle being a refrigeration cycle device for circulating a high-temperature-side refrigerant and a low-stage refrigeration cycle being a refrigeration cycle device for circulating a low-temperature-side refrigerant has been used. One example of the two-stage refrigeration apparatus has a multistage configuration in which the low-stage refrigeration cycle and the high-stage refrigeration cycle are connected by a cascade condenser configured to allow a low-stage-side condenser in the low-stage refrigeration cycle and a high-stage-side evaporator in the high-stage refrigeration cycle to exchange heat with each other.

One example of such a two-stage refrigeration apparatus is the one in which when a low-stage-side compressor in the low-stage refrigeration cycle is inactive, a high-stage-side compressor in the high-stage refrigeration cycle is driven (see, for example, Patent Literature 1). In this two-stage refrigeration apparatus, during defrosting operation, the low-stage-side condenser in the low-stage refrigeration cycle is cooled by cooling a cascade heat exchanger by the evaporator in the high-stage refrigeration cycle to suppress a pressure rise inside the low-stage refrigeration cycle.

Another example of the refrigeration apparatus is the one in which, in the low-stage refrigeration cycle, a cooling pipe is connected through a collector disposed between the cascade condenser (low-stage-side condenser) and the cooler and a refrigerating machine and the cooling pipe are connected by a pipe (see, for example, Patent Literature 2). In this refrigeration apparatus, at the time the operation of the refrigeration apparatus is stopped, the refrigerating machine is operated, the cooling pipe is cooled, the refrigerant gas inside the collector is cooled, and the gas pressure of the refrigerant flowing in the low-stage refrigeration cycle is reduced.

CITATION LIST

Patent Literature

Patent Literature 1: Japanese Unexamined Patent Application Publication No. 2004-190917

Patent Literature 2: Japanese Unexamined Utility Model Registration Application Publication No. 2-4167

SUMMARY OF INVENTION

Technical Problem

For example, in the known refrigeration apparatus described in Patent Literature 1, the refrigerant inside the low-stage refrigeration cycle is cooled by the cascade heat exchanger. In the low-stage refrigeration cycle, for example, in hot-gas defrosting, which performs defrosting by causing a high-temperature refrigerant discharged from the low-stage-side compressor to flow into the low-stage-side evaporator, it is necessary to bypass the cascade condenser (low-stage-side condenser) in order to prevent the refrigerant from transferring heat before flowing. When it is bypassed, the refrigerant inside the low-stage refrigeration cycle does not flow inside the low-stage-side condenser. Accordingly, for example, if the refrigerant condenses to some degree and the low-stage-side condenser in the low-stage refrigeration cycle is filled with the liquid refrigerant in the cascade condenser, a problem arises in that the cooling is not sufficient.

In the known refrigerant apparatus described in Patent Literature 2, in addition to the high-stage refrigeration cycle and low-stage refrigeration cycle, one more refrigerating machine is needed to cool the collector. This leads to problems such as the increased size of the equipment and costly production of the refrigeration apparatus.

The present invention is made to solve the above problems and provides a two-stage refrigeration apparatus capable of preventing an abnormal pressure rise in a refrigerant (refrigerant circuit) during defrosting in a low-stage refrigeration cycle, for example, and achieving improved reliability.

Solution to Problem

A two-stage refrigeration apparatus according to the present invention includes a first refrigeration cycle device, a second refrigeration cycle device, a cascade condenser, a receiver heat exchanging portion, defrosting means, second-refrigerant-circuit pressure determining means, and a controller. The first refrigeration cycle device includes a first refrigerant circuit in which a first compressor, a first condenser, a first expansion device, and a first evaporator are connected by pipes. The first refrigerant circuit circulates a first refrigerant. The second refrigeration cycle device includes a second refrigerant circuit in which a second compressor, a second condenser, a receiver, a second expansion device, and a second evaporator are connected by pipes. The second refrigerant circuit circulates a second refrigerant. The cascade condenser includes the first evaporator and the second condenser and is configured to cause the first refrigerant flowing in the first evaporator and the second refrigerant flowing in the second condenser to exchange heat with each other. The receiver heat exchanging portion is configured to cool the receiver by heat exchange with a portion in which the first refrigerant being low-pressure flows in the first refrigerant circuit. The defrosting means is configured to defrost the second evaporator. The second-refrigerant-circuit pressure determining means is configured to determine a pressure of the second refrigerant in the second refrigerant circuit. The controller is configured to perform controlling so as to activate the first compressor and cause the first refrigerant to flow into the receiver heat exchanging portion when estimating that the second refrigerant will reach a supercritical state while the second evaporator is being defrosted by the defrosting means on the basis of the pressure of the second refrigerant relating to the determination by the second-refrigerant-circuit pressure determining means.

Advantageous Effects of Invention

In the two-stage refrigeration apparatus of the present invention, when it is determined that the second refrigerant inside the second refrigeration cycle device will reach the supercritical state, the first compressor is activated and the second refrigerant is cooled in the receiver heat exchanging portion. Thus the pressure of the second refrigerant inside the second refrigerant cycle device can be maintained at a pressure lower than a predetermined saturation pressure, for example, a pressure lower than the critical-point pressure, and the reliability of the apparatus can be improved.

DESCRIPTION OF EMBODIMENTS

Embodiment 1

Figure 1:
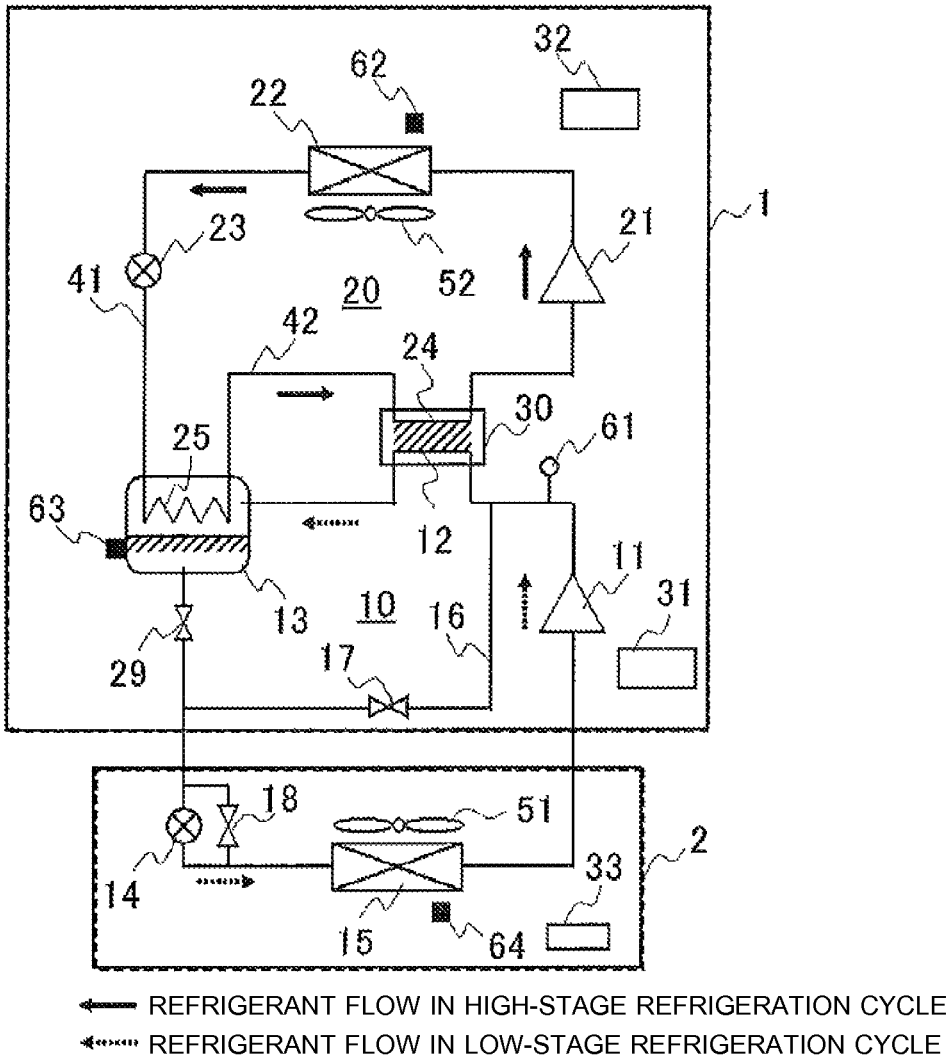
FIG. 1 illustrates a configuration of a two-stage refrigeration apparatus of Embodiment 1 of the present invention.

FIG. 1 illustrates a configuration of a two-stage refrigeration apparatus according to Embodiment 1 of the present invention. In FIG. 1, the two-stage refrigeration apparatus of Embodiment 1 includes a low-stage refrigeration cycle 10 and a high-stage refrigeration cycle 20, each of which is a refrigeration cycle device that performs heat-pumping by circulating a sealed-in refrigerant. The low-stage refrigeration cycle 10 and high-stage refrigeration cycle 20 can independently circulate their refrigerants. Here, for the expressions of high, low, and the like in temperature, pressure, and the like, being high, low, or the like is not determined on the basis of a relationship with any absolute value, but is relatively determined in a state, action, or the like in a system, apparatus, or the like.

As the refrigerant sealed in the low-stage refrigeration cycle 10 (hereinafter referred to as low-temperature-side refrigerant), carbon dioxide (CO2), which has a small impact on global warming, is used in consideration of refrigerant leakage. Examples of the refrigerant sealed in the high-stage refrigeration cycle 20 (hereinafter referred to as high-temperature-side refrigerant) may include R410A, R32, R404A, HFO-1234yf, propane, isobutane, carbon dioxide, and ammonia.

The two-stage refrigeration apparatus further includes three controllers: a low-stage refrigeration cycle controller 31, a high-stage refrigeration cycle controller 32, and an indoor-unit controller 33. These controllers control the apparatus in cooperation with one another. Here, the low-stage refrigeration cycle controller 31 and indoor-unit controller 33 control the operations of the low-stage refrigeration cycle 10. The high-stage refrigeration cycle controller 32 controls the operations of the high-stage refrigeration cycle 20. The details of each of the controllers are described later.

The low-stage refrigeration cycle 10 includes a refrigerant circuit in which a low-stage-side compressor 11, a low-stage-side condenser 12, a low-stage-side receiver 13, a receiver outlet valve 29, a low-stage-side expansion valve 14, and a low-stage-side evaporator 15 are connected together in a loop in this order by refrigerant pipes (hereinafter referred to as low-stage-side refrigerant circuit). The details of each equipment are described later. The low-stage refrigeration cycle 10 further includes a second bypass valve 18 for enabling the low-stage-side refrigerant to pass therethrough in parallel with the stream passing through the low-stage-side expansion valve 14 while bypassing the low-stage-side expansion valve 14. The low-stage refrigeration cycle 10 also includes a bypass 16 being a pipe connecting the pipe between the low-stage-side compressor 11 and the low-stage-side condenser 12 and the pipe between the receiver outlet valve 29 and the low-stage-side expansion valve 14. The bypass 16 is connected to a first bypass valve 17.

Here, the low-stage-side refrigerant circuit corresponds to "second refrigerant circuit" in the present invention, and the low-stage-side refrigerant corresponds to "second refrigerant." The low-stage-side compressor 11 corresponds to "second compressor," the low-stage-side condenser 12 corresponds to "second condenser," and the low-stage-side receiver 13 corresponds to "receiver." The low-stage-side expansion valve 14 corresponds to "second expansion device," the low-stage-side evaporator 15 corresponds to "second evaporator," and the receiver outlet valve 29 corresponds to "receiver outlet opening and closing device."

The high-stage refrigeration cycle 20 includes a refrigerant circuit in which a high-stage-side compressor 21, a high-stage-side condenser 22, a high-stage-side expansion valve 23, a receiver heat exchanging portion 25, and a high-stage-side evaporator 24 are connected together in a loop in this order by refrigerant pipes (hereinafter referred to as high-stage-side refrigerant circuit). The details of each equipment are described later.

Here, the high-stage-side refrigerant circuit corresponds to "first refrigerant circuit" in the present invention, and the high-stage-side refrigerant corresponds to "first refrigerant." The high-stage-side compressor 21 corresponds to "first compressor," the high-stage-side condenser 22 corresponds to "first condenser," the high-stage-side expansion valve 23 corresponds to "first expansion device," and the high-stage-side evaporator 24 corresponds to "first evaporator." The control relating to the present invention is conducted by the high-stage refrigeration cycle controller 32. Thus the high-stage refrigeration cycle controller 32 corresponds to "controller." As described later, the high-stage refrigeration cycle controller 32 receives pressures and temperatures relating to detection from a pressure sensor 61 and temperature sensors 62 and 63 as signals. The high-stage refrigeration cycle controller 32 functions as determining means, estimating means, estimating and calculating means and the like being part of second-refrigerant-circuit pressure determining means configured to determine a pressure of the second refrigerant inside the second refrigerant circuit.

A cascade condenser (refrigerant heat exchanger) 30 in which the high-stage-side evaporator 24 and the low-stage-side condenser 12 are connected such that heat exchange is allowed between the refrigerant passing through the high-stage-side evaporator 24 and that through the low-stage-side condenser 12 is disposed to achieve a multistage configuration.

Here, in Embodiment 1, the low-stage-side compressor 11, low-stage-side condenser 12 (cascade condenser 30), low-stage-side receiver 13, bypass 16, first bypass valve 17 and receiver outlet valve 29 in the low-stage refrigeration cycle 10 and the equipment included in the high-stage refrigeration cycle 20 are housed in an outdoor unit (heat source unit) 1 placed outside a room. The low-stage refrigeration cycle controller 31, high-stage refrigeration cycle controller 32, and a high-stage-side condenser fan 52 are also housed in the outdoor unit 1. The low-stage-side expansion valve 14, low-stage-side evaporator 15, second bypass valve 18, a low-stage-side evaporator fan 51, and the indoor-unit controller 33 are housed in an indoor unit (unit cooler) 2.

Figure 2:
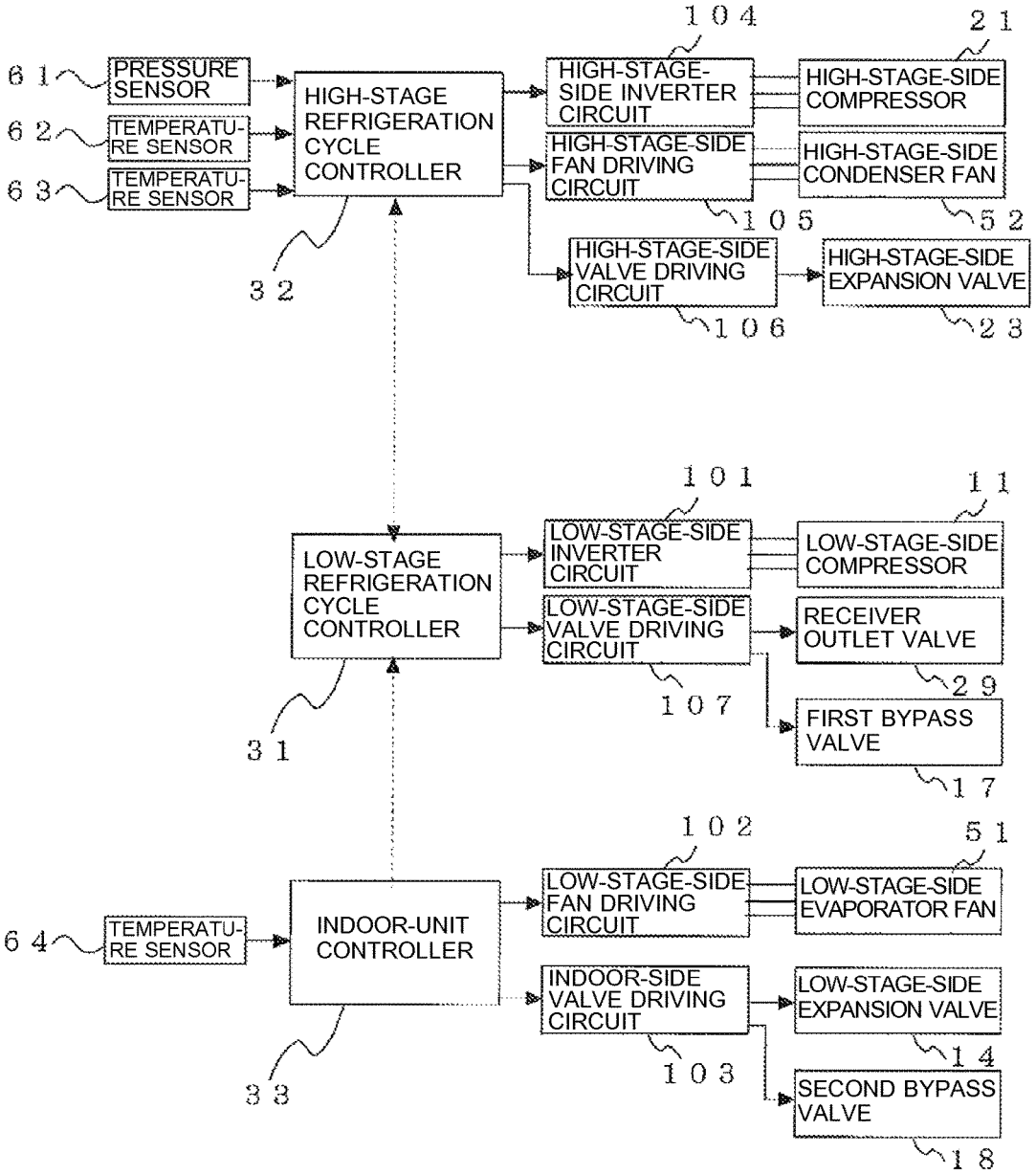
FIG. 2 illustrates a configuration of a control system in the two-stage refrigeration apparatus of Embodiment 1 of the present invention.

FIG. 2 illustrates a configuration of a control system in the two-stage refrigeration apparatus according to Embodiment 1 of the present invention. As previously described, the operations in the two-stage refrigeration apparatus in Embodiment 1 are controlled by the low-stage refrigeration cycle controller 31, high-stage refrigeration cycle controller 32, and indoor-unit controller 33. Each of the controllers has a configuration including, for example, a microcomputer, a storage device, a peripheral circuit, and the like.

Here, the low-stage refrigeration cycle controller 31 and high-stage refrigeration cycle controller 32 can be connected by, for example, a communication line and can perform communication (e.g., transmission and reception of a serial signal) therebetween. The low-stage refrigeration cycle controller 31 and indoor-unit controller 33 can also be connected by, for example, a communication line and can communicate with each other. In Embodiment 1, the indoor-unit controller 33 transmits, to the low-stage refrigeration cycle controller 31, an on/off signal of the indoor unit 2, an instruction to start or end defrosting the indoor unit 2, and the like.

The low-stage refrigeration cycle controller 31 outputs signals to a low-stage-side inverter circuit 101 and a low-stage-side valve driving circuit 107. The high-stage refrigeration cycle controller 32 receives signals relating to detection from the pressure sensor 61 and temperature sensors 62 and 63. The high-stage refrigeration cycle controller 32 outputs signals to a high-stage-side inverter circuit 104, a high-stage-side fan driving circuit 105, and a high-stage-side valve driving circuit 106. The indoor-unit controller 33 receives signals relating to detection from a temperature sensor 64. The indoor-unit controller 33 outputs signals to a low-stage-side fan driving circuit 102 and an indoor-side valve driving circuit 103.

The low-stage-side inverter circuit 101 is a circuit configured to output an AC power (voltage) to the low-stage-side compressor 11 in accordance with an instruction from the low-stage refrigeration cycle controller 31 and configured to drive the low-stage-side compressor 11 with an operating frequency (rotation speed) corresponding to the AC power. The high-stage-side inverter circuit 104 is a circuit configured to drive the high-stage-side compressor 21 with an operating frequency in accordance with an instruction from the high-stage refrigeration cycle controller 32.

The low-stage-side fan driving circuit 102 is a circuit configured to output an AC power (voltage) to the low-stage-side evaporator fan 51 in accordance with an instruction from the indoor-unit controller 33 and configured to drive the low-stage-side evaporator fan 51 with an operating frequency corresponding to the AC power. The high-stage-side fan driving circuit 105 is a circuit configured to drive the high-stage-side condenser fan 52 with an operating frequency in accordance with an instruction from the high-stage refrigeration cycle controller 32.

The indoor-side valve driving circuit 103 is configured to set the opening degree of the low-stage-side expansion valve 14 and the opening or closing of the second bypass valve 18 in accordance with an instruction from the indoor-unit controller 33. The low-stage-side valve driving circuit 107 is configured to set the opening or closing of the first bypass valve 17 and the opening or closing of the receiver outlet valve 29 in accordance with an instruction from the low-stage refrigeration cycle controller 31. The high-stage-side valve driving circuit 106 is configured to set the opening degree of the high-stage-side expansion valve 23 in accordance with an instruction from the high-stage refrigeration cycle controller 32.

The low-stage-side compressor 11 is configured to suck the low-stage-side refrigerant, compress it to a high-temperature and high-pressure state, and discharge it. The low-stage-side compressor 11 is a compressor of the type allowing the rotation speed to be controlled by the low-stage-side inverter circuit 101 and allowing the amount of discharging the refrigerant to be adjusted.

The low-stage-side condenser 12 is configured to condense the refrigerant to the liquid state (condense and liquefy). In Embodiment 1, for example, in the cascade condenser 30, a heat exchanger tube through which the refrigerant flowing in the low-stage-side refrigerant circuit passes or the like constitutes the low-stage-side condenser 12, and the refrigerant flowing in the low-stage-side refrigerant circuit exchanges heat with the refrigerant flowing in the high-stage-side refrigerant circuit. The low-stage-side receiver 13 is disposed downstream of the low-stage-side condenser 12 and is configured to store the refrigerant.

One example of the low-stage-side expansion valve 14 may be an electronic expansion valve. The low-stage-side expansion valve 14 is configured to decompress the refrigerant by adjusting the flow rate of the refrigerant. The low-stage-side expansion valve 14 may be refrigerant flow rate adjusting means such as a capillary or a temperature-sensitive expansion valve.

The low-stage-side evaporator 15 is configured to evaporate the refrigerant flowing in the low-stage refrigerant circuit by, for example, heat exchange with an object to be cooled to the gas refrigerant (evaporate and gasify). The object to be cooled is directly or indirectly cooled by heat exchange with the refrigerant. In Embodiment 1, the object to be cooled is air, the air and the refrigerant exchange heat with each other, and the low-stage-side evaporator fan 51 is disposed to facilitate the heat exchange.

The high-stage-side compressor 21 is configured to suck the high-stage-side refrigerant, compress it to a high-temperature and high-pressure state, and discharge it. The high-stage-side compressor 21 is a compressor of the type allowing the rotation speed to be controlled by the high-stage-side inverter circuit 104 and allowing the amount of discharging the refrigerant to be adjusted.

The high-stage-side condenser 22 is configured to cause, for example, air, brine, or the like and the refrigerant flowing in the high-stage-side refrigerant circuit to exchange heat with each other and condense and liquefy the refrigerant. In Embodiment 1, that heat exchange is carried out between the outside air and the refrigerant, and the high-stage-side condenser fan 52 is disposed to facilitate that heat exchange. The high-stage-side condenser fan 52 is also a fan of the type allowing the quantity of air to be adjusted.

One example of the high-stage-side expansion valve 23 may be an electronic expansion valve. The high-stage-side expansion valve 23 is configured to decompress the refrigerant by adjusting the flow rate of the refrigerant. The high-stage-side expansion valve 23 may be refrigerant flow rate adjusting means such as a capillary or a temperature-sensitive expansion valve.

The high-stage-side evaporator 24 is configured to evaporate and gasify the refrigerant flowing in the high-stage refrigerant circuit by heat exchange. In Embodiment 1, for example, in the cascade condenser 30, a heat exchanger tube through which the refrigerant flowing in the high-stage-side refrigerant circuit passes or the like constitutes the high-stage-side evaporator 24, and the refrigerant flowing in the high-stage-side refrigerant circuit exchanges heat with the refrigerant flowing in the low-stage-side refrigerant circuit.

The cascade condenser 30 includes the high-stage-side evaporator 24 and the low-stage-side condenser 12 and is a refrigerant heat exchanger configured to enable the refrigerant flowing in the high-stage-side evaporator 24 and the refrigerant flowing in the low-stage-side condenser 12 to exchange heat with each other. The multistage configuration including the high-stage-side refrigerant circuit and the low-stage-side refrigerant circuit connected through the cascade condenser 30 and allowing heat exchange between the refrigerants can enable the independent refrigerant circuits to work in cooperation with each other.

The two-stage refrigeration apparatus of Embodiment 1 includes the receiver heat exchanging portion 25 configured to cool the low-stage-side receiver 13 in the low-stage-side refrigerant circuit on the low-pressure side of the high-stage-side refrigerant circuit. At the receiver heat exchanging portion 25, the refrigerant flowing in the high-stage-side refrigerant circuit is evaporated and gasified inside it, and the refrigerant flowing in the low-stage-side refrigerant circuit is condensed and liquefied outside it. The receiver heat exchanging portion 25 may be a refrigerant pipe disposed inside the container of the low-stage-side receiver 13, and the pipe may have a groove for facilitating heat transfer in its inner portion, a fin for facilitating heat transfer on its outer portion, or the like. The receiver heat exchanging portion 25 may not be disposed inside the low-stage-side receiver 13 and may be wound on the outside of the low-stage-side receiver 13 so as to allow heat exchange with the outside of the low-stage-side receiver 13.

The low-stage refrigeration cycle 10 includes the first bypass valve 17, second bypass valve 18, and receiver outlet valve 29, each of which may be, for example, a solenoid valve, so as to be able to cause the refrigerant to flow or stop.

The pressure sensor 61 is refrigerant pressure detecting means. The pressure sensor 61 is disposed on a pipe between the low-stage-side compressor 11 and the refrigerant inlet side of the low-stage-side expansion valve 14 in the low-stage side refrigerant circuit and is configured to detect the pressure of the low-stage-side refrigerant on the high-pressure side of the low-stage-side refrigerant circuit. The temperature sensor 62 may be disposed on the air suction side of the high-stage-side condenser 22, for example, and is configured to detect the outside-air temperature. The temperature sensor 63 may be disposed on the surface of the low-stage-side receiver 13, for example, and is configured to detect the temperature of the liquid refrigerant on the high-pressure side of the low-stage-side refrigerant circuit. The temperature sensor 64 may be disposed on the air suction side of the low-stage-side evaporator 15, for example, and is configured to detect the temperature of air to be cooled. The pressure sensor 61 and temperature sensors 62, 63, and 64 can be disposed in any locations at which they can detect the pressure of the high-stage-side refrigerant on the high-pressure side of the high-stage-side refrigerant circuit, the outside-air temperature, the temperature of the liquid refrigerant on the high-pressure side of the low-stage-side refrigerant circuit, and the temperature of air to be cooled, respectively, and their locations are not limited. Here, the pressure sensor 61 corresponds to "pressure detecting device," the temperature sensor 63 corresponds to "liquid-refrigerant temperature detecting device," and they are part of the second-refrigerant-circuit pressure determining means.

In Embodiment 1, the low-stage refrigeration cycle controller 31 and high-stage refrigeration cycle controller 32 are separately disposed and can exchange various control instructions and the like therebetween using serial signals. In the two-stage refrigeration apparatus such as the one in Embodiment 1, many pieces of equipment, such as the low-stage-side compressor 11, high-stage-side compressor 21, and high-stage-side condenser fan 52, whose rotation speeds are controlled, and the high-stage-side expansion valve 23, whose opening degree is controlled, are independently controlled in accordance with the operating state, and thus large loads are imposed on the controllers. Accordingly, an independent controller may preferably be provided to each of the low-stage refrigeration cycle 10 and high-stage refrigeration cycle 20.

The indoor unit 2 may be, for example, a load device in a showcase or the like placed in a supermarket or the like. When the temperature detected by the temperature sensor 64 being a suction sensor in a showcase reaches an upper limit value, the operation of the indoor unit 2 is turned on, and an on signal is transmitted from the indoor-unit controller 33 to the low-stage refrigeration cycle controller 31. After that, the low-stage refrigeration cycle controller 31 transmits an operating instruction to the high-stage refrigeration cycle controller 32.

In the low-stage-side evaporator 15, the moisture in the air or moisture from the food condenses thereon in the form of frost. For example, when the cooling operation of cooling an object to be cooled (normal operation) has been performed for several hours, the low-stage-side evaporator 15 is covered with frost, the airflow resistance increases, the quantity of air decreases, the heat resistance between the refrigerant and air increases, and the refrigeration capacity decreases. To avoid the decrease in the capacity, the low-stage-side evaporator 15 is defrosted approximately once every several hours. At this time, the indoor-unit controller 33 transmits starting and ending of the defrosting operation to the low-stage refrigeration cycle controller 31.

Here, in the two-stage refrigeration apparatus, the indoor unit 2 in the low-stage refrigeration cycle 10 may be arranged in an indoor load device, such as, a showcase or the like placed in, for example, a supermarket or the like. For example, if the showcase is relocated or the like, the connections of the pipes are changed or the like, and the refrigerant circuit is opened, the possibility of refrigerant leakage increases. Thus as the low-temperature-side refrigerant, a material that has a small impact on global warming (has a low global warming potential) is used. In contrast, because the high-stage-side refrigerant circuit is opened with a low frequency, even when the refrigerant has a high global warming potential, a problem is unlikely to occur. Thus a material can be selected as the high-temperature-side refrigerant in consideration of the operating efficiency, and, for example, a hydrofluorocarbon (HFC) refrigerant can be used. Other examples of the high-temperature-side refrigerant may include a hydrocarbon (HC) refrigerant and ammonia.

(Overview of Normal Cooling Operation Action)

Action and the like of each constituent equipment in normal cooling operation of cooling air to be cooled in the two-stage refrigeration apparatus having the above-described configuration is described below on the basis of the flow of the refrigerant circulating in each of the refrigerant circuits.

(Action of High-Stage Refrigeration Cycle 20)

First, action of the high-stage refrigeration cycle 20 is described. The high-stage-side compressor 21 sucks the high-stage-side refrigerant, compresses it to a high-temperature and high-pressure state, and discharges it. The discharged high-stage-side refrigerant flows into the high-stage-side condenser 22. The high-stage-side condenser 22 causes the outside air supplied by driving the high-stage-side condenser fan 52 and the high-stage-side refrigerant to exchange heat with each other and condenses and liquefies the high-stage-side refrigerant. The condensed and liquefied refrigerant passes through the high-stage-side expansion valve 23. The high-stage-side expansion valve 23 decompresses the condensed and liquefied refrigerant. The decompressed refrigerant flows into the receiver heat exchanging portion 25 and the high-stage-side evaporator 24 (cascade condenser 30) in this order. The receiver heat exchanging portion 25 evaporate the high-stage-side refrigerant by heat exchange with the low-stage-side refrigerant in the low-stage-side receiver 13. The high-stage-side evaporator 24 evaporates and gasifies the high-stage-side refrigerant by heat exchange with the low-stage-side refrigerant passing through the low-stage-side condenser 12. The evaporated and gasified high-stage-side refrigerant is sucked into the high-stage-side compressor 21.

Here, for example, the high-stage refrigeration cycle controller 32 may control the rotation speed of the high-stage-side compressor 21 such that a low-pressure-side saturation temperature in the high-stage-side refrigerant circuit is a predetermined target value. For example, the high-stage refrigeration cycle controller 32 may control the rotation speed of the high-stage-side condenser fan 52 such that a high-pressure-side saturation temperature in the high-stage-side refrigerant circuit is a predetermined target value. For example, the high-stage refrigeration cycle controller 32 may control the opening degree of the high-stage-side expansion valve 23 such that the degree of superheat at the refrigerant outlet of the high-stage-side evaporator 24 is a predetermined target value.

(Action of Low-Stage Refrigeration Cycle 10)

Next, action of the low-stage refrigeration cycle 10 is described. The low-stage-side compressor 11 sucks the low-stage-side refrigerant, compresses it to a high-temperature and high-pressure state, and discharges it. The discharged low-stage-side refrigerant flows into the low-stage-side condenser 12 (cascade condenser 30). The low-stage-side condenser 12 condenses the low-stage-side refrigerant by heat exchange with the high-stage-side refrigerant passing through the high-stage-side evaporator 24. The condensed refrigerant flows into the low-stage-side receiver 13 and is further condensed in the receiver heat exchanging portion 25. At this time, the receiver outlet valve 29 is in an open state, and part of the condensed and liquefied low-temperature-side refrigerant does not remain in the low-stage-side receiver 13 and passes through the receiver outlet valve 29. The low-stage-side expansion valve 14 decompresses the condensed and liquefied refrigerant. The decompressed low-stage-side refrigerant flows into the low-stage-side evaporator 15. The low-stage-side evaporator 15 evaporates and gasifies the low-temperature-side refrigerant by heat exchange with an object to be cooled. The evaporated and gasified low-stage-side refrigerant is sucked into the low-stage-side compressor 11. Here, to store a predetermined amount of the condensed and liquefied low-temperature-side refrigerant in the low-stage-side receiver 13, the pressure during operation on the high-pressure side of the low-stage-side refrigerant circuit (high-pressure-side pressure) may preferably be less than the pressure at the critical point (critical-point pressure). Here, the first bypass valve and second bypass valve are closed to block the passage of the low-stage-side refrigerant.

For example, the low-stage refrigeration cycle controller 31 may control the rotation speed of the low-stage-side compressor 11 such that a low-pressure-side saturation temperature in the low-stage refrigeration cycle 10 is a predetermined target value. For example, the indoor-unit controller 33 may control the opening degree of the low-stage-side expansion valve 14 such that the degree of superheat at the refrigerant outlet of the low-stage-side evaporator 15 is a predetermined target value.

(Overview of Hot-Gas Defrosting Operation Action)

In defrosting the low-stage-side evaporator 15, the two-stage refrigeration apparatus in Embodiment 1 performs hot-gas defrosting of causing a high-temperature refrigerant exiting from the low-stage-side compressor 11 to flow into the inlet of the low-stage-side evaporator 15. At the time the hot-gas defrosting operation starts, the high-stage refrigeration cycle 20 (high-stage-side refrigerant circuit) is stopped. In the low-stage refrigeration cycle 10, the receiver outlet valve 29 is closed, the first bypass valve 17 and second bypass valve 18 are opened, and the low-stage-side expansion valve 14 is fully opened. The low-stage-side compressor 11 is driven, whereas the low-stage-side evaporator fan 51 is stopped.

The high-temperature low-stage-side refrigerant circuit exiting from the low-stage-side compressor 11 runs through the bypass 16, passes through the first bypass valve 17, low-stage-side expansion valve 14, and second bypass valve 18, and flows into the low-stage-side evaporator 15. In the low-stage-side evaporator 15, frost is melted by heat of the low-stage-side refrigerant, the temperature of the refrigerant decreases, and the refrigerant is sucked into the low-stage-side compressor 11 again.

(Action of High-Stage Refrigeration Cycle 20 During Hot-Gas Defrosting in Low-Stage Refrigeration Cycle 10)

Here, the necessity of suppressing a pressure rise in the low-stage-side refrigerant circuit during hot-gas defrosting in the low-stage refrigeration cycle 10 is described. In the hot-gas defrosting operation, the refrigerant in the low-stage-side condenser 12 is not condensed, and thus the low-stage-side refrigerant circuit is a gas cycle. Accordingly, the redundant refrigerant tends to increase, and the pressure in the low-stage-side refrigerant circuit tends to increase. In addition, because the high-temperature low-stage-side refrigerant exiting from the low-stage-side compressor 11 runs in the low-stage-side refrigerant circuit and flows into the low-stage-side evaporator 15, the temperature in the low-stage-side refrigerant circuit tends to increase, and, for example, there is a possibility that the low-stage-side receiver 13 in which the low-stage-side liquid refrigerant is stored or the like is heated by heat conduction of the pipe warmed by the low-temperature-side refrigerant. Although the receiver outlet valve 29 is closed, there is a possibility that a small quantity of the high-temperature refrigerant exiting from the low-stage-side compressor 11 runs through the low-stage-side condenser 12, flows into the low-stage-side receiver 13, and heats the refrigerant stored in the low-stage-side receiver 13.

In Embodiment 1, CO2 is used as the low-stage-side refrigerant. The temperature at the critical point (critical-point temperature) of CO2 is approximately 31 degrees centigrade, which is lower than that in other refrigerants. Thus the pressure inside the low-stage-side refrigerant circuit increases with a temperature rise, and the low-stage-side refrigerant may reach a supercritical state. If the pressure of CO2 is at or above the critical-point pressure, the degree of the pressure rise tends to be higher than that of the temperature rise. Thus if occurrences in which the low-stage-side refrigerant in the low-stage-side refrigerant circuit reaches a supercritical state are permitted, pressure resistance design is necessary for the equipment to support a substantial pressure rise inside the low-stage-side refrigerant circuit, thus the design pressure of the equipment significantly increase, and this leads to a large size of the equipment and poor economy.

For the above-described reasons, in order to suppress a pressure rise in the low-stage-side refrigerant circuit during hot-gas defrosting operation for the low-stage-side evaporator 15, it may be preferable that the pressure rise in the low-stage-side refrigerant circuit is detected, the high-stage refrigeration cycle 20 is operated, and the low-stage-side refrigerant circuit is cooled.

In the two-stage refrigeration apparatus according to Embodiment 1, even when the low-stage refrigeration cycle 10 is inactive, the pressure rise in the low-stage-side refrigerant circuit occurring with the temperature rise can be suppressed by operating the high-stage refrigeration cycle 20 (high-stage-side refrigerant circuit) and cooling the low-stage-side receiver 13 using a low-pressure portion in the high-stage-side refrigerant circuit. Such action of the high-stage refrigeration cycle 20 while the low-stage refrigeration cycle 10 is inactive is described below.

(Method for Operation of Suppressing Pressure Rise in Low-Stage-Side Refrigerant Circuit)

Figure 3:
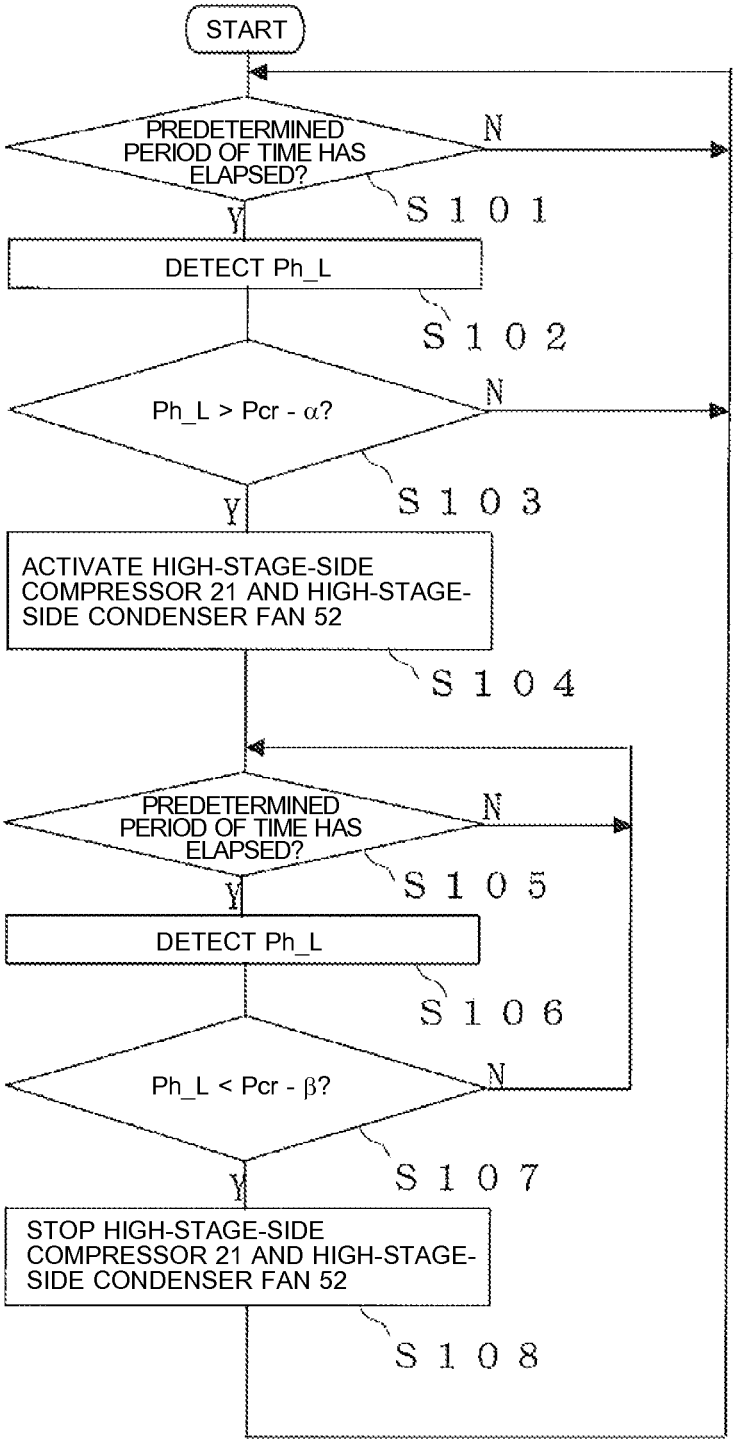
FIG. 3 is a flowchart of a process for suppressing a pressure rise in a low-stage-side refrigerant circuit in Embodiment 1 of the present invention.

FIG. 3 is a flowchart of a pressure adjusting process in the low-stage-side refrigerant circuit in Embodiment 1 of the present invention. Here, the action of activating the high-stage refrigeration cycle 20 depending on the pressure of the low-stage-side refrigerant in the low-stage-side refrigerant circuit relating to detection by the pressure sensor 61 during hot-gas defrosting in the low-stage refrigeration cycle 10 is described with reference to FIG. 3. When the low-stage refrigeration cycle 10 (low-stage-side refrigerant circuit) starts the defrosting operation, the high-stage refrigeration cycle controller 32 starts this process, and the process continues while the low-stage-side compressor 11 is being defrosted.

The high-stage refrigeration cycle controller 32 determines whether a predetermined period of time has elapsed since the start of the process (step S101). When the high-stage refrigeration cycle controller 32 determines that the predetermined period of time has elapsed (YES), it acquires (determines) a high-pressure-side pressure Ph_L in the low-stage-side refrigerant circuit relating to detection by the pressure sensor 61 (step S102). Here, one example of the predetermined period of time may be approximately one minute.

The high-stage refrigeration cycle controller 32 determines whether the high-pressure-side pressure Ph_L in the low-stage-side refrigerant circuit is larger than a value obtained by subtracting a threshold $\alpha$ from a critical-point pressure Pcr of CO2 (step S103). When the high-stage refrigeration cycle controller 32 determines that Ph_L is larger (YES), the process proceeds to step S104 and subsequent steps. In contrast, when the high-stage refrigeration cycle controller 32 determines that Ph_L is not larger (NO), the process returns to step S101 and continues. Here, the critical-point pressure Pcr of CO2 is approximately 7.38 MPa (hereinafter the unit of pressure indicates an absolute value). The high-stage refrigeration cycle controller 32 retains the value of the critical-point pressure Pcr in advance.

The high-stage refrigeration cycle controller 32 activates the high-stage-side compressor 21 (preferably, also activates the high-stage-side condenser fan 52). This operates the high-stage-side refrigerant circuit (step S104).

The high-stage refrigeration cycle controller 32 determines whether a predetermined period of time has elapsed (step S105). When the high-stage refrigeration cycle controller 32 determines that the predetermined period of time has elapsed (YES), it acquires (determines) the high-pressure-side pressure Ph_L in the low-stage-side refrigerant circuit relating to detection by the pressure sensor 61 again (step S106). Here, the predetermined period of time may be preferably approximately one minute.

The high-stage refrigeration cycle controller 32 determines whether the high-pressure-side pressure Ph_L in the low-stage-side refrigerant circuit is smaller than a value obtained by subtracting a threshold $\beta$ from the critical-point pressure Pcr of CO2 (step S107). When the high-stage refrigeration cycle controller 32 determines that Ph_L is smaller (YES), it stops the high-stage-side compressor 21 and high-stage-side condenser fan 52 (step S108), and the process returns to step S101 and continues. In contrast, when the high-stage refrigeration cycle controller 32 determines that Ph_L is not smaller (NO), the process returns to step S105 and continues.

As described above, in Embodiment 1, when it is estimated that, during hot-gas defrosting in the low-stage refrigeration cycle 10, the pressure inside the low-stage-side refrigerant circuit will reach or exceed (may reach or exceed) the critical-point pressure, the high-stage-side compressor 21 is activated and the low-stage-side refrigerant circuit (low-stage-side refrigerant) is cooled by the receiver heat exchanging portion 25. Thus a pressure rise in the low-temperature-side refrigerant inside the low-stage-side refrigerant circuit during defrosting operation can be suppressed by cooling performed by the high-stage refrigeration cycle 20, which is housed in the same outdoor unit 1. Accordingly, the reliability of the two-stage refrigeration apparatus can be improved. Even when the low-temperature-side refrigerant is CO2, which has a critical-point temperature lower than that in other refrigerants, it is not necessary to use an excessively large receiver or set a high design pressure in the equipment, and the advantage of cost reduction can also be expected.

In the two-stage refrigeration apparatus in Embodiment 1, the high-stage refrigeration cycle controller 32 acquires the high-pressure-side pressure Ph_L in the low-stage-side refrigerant circuit detected by the pressure sensor 61 and determines whether it is necessary to suppress a pressure rise in the low-stage-side refrigerant circuit. When the high-stage refrigeration cycle controller 32 determines that it is necessary, it suppresses the pressure rise of the low-stage-side refrigerant inside the low-stage-side refrigerant circuit by activating the high-stage-side compressor 21, operating the high-stage refrigeration cycle 20, thus causing the low-temperature high-stage-side refrigerant to pass through the receiver heat exchanging portion 25, cooling the low-stage-side receiver 13, and thereby cooling the low-stage-side refrigerant. Accordingly, the high-stage refrigeration cycle controller 32 can solely perform the process, thus obviating the necessity to communicate with the low-stage refrigeration cycle controller 31 and indoor-unit controller 33. Therefore, even if a defect occurs in communications between the controllers or even if part of the equipment in the low-stage refrigeration cycle 10 is broken, or the like, the pressure rise in the low-stage-side refrigerant circuit can be suppressed more reliably.

In step S103, for the high-pressure-side pressure Ph_L in the low-stage-side refrigerant circuit, the high-pressure-side pressure Ph_L being the condition for starting the operation of suppressing the pressure rise, the threshold α is set for the critical-point pressure Pcr of CO2. Thus occurrences in which Ph_L exceeds Pcr after the operation of suppressing the pressure rise in the low-stage-side refrigerant circuit is started and before the low-stage-side receiver 13 is actually cooled can be suppressed. Here, the condition of the high-pressure-side pressure Ph_L to start is a saturation pressure lower than the critical-point pressure. Next, a method of calculating the saturation pressure is described. In consideration of tolerance of approximately 3 to 5 degrees centigrade from 31 degrees centigrade, which is the critical-point temperature of CO2, the saturation temperature is set at approximately 26 to 28 degrees centigrade. The saturation pressure of CO2 in this case is determined to 6.58 to 6.89 MPa by conversion. Accordingly, the threshold α, which is the difference from the critical-point pressure Pcr (approximately 7.38 MPa), may be approximately 0.5 to 0.8 MPa.

In step S107, for the high-pressure-side pressure Ph_L in the low-stage-side refrigerant circuit, the high-pressure-side pressure Ph_L being the condition for determining that the low-stage-side receiver 13 has been cooled and ending the operation of suppressing the pressure rise in the low-stage-side refrigerant circuit, the threshold β is set for the critical-point pressure Pcr of CO2. Thus in ending the operation of suppressing the pressure rise in the low-stage-side refrigerant circuit, Ph_L is lower than Pcr, a saturated state exists, and the liquid refrigerant can be stored in the low-stage-side receiver 13. Here, setting β at a value larger than a enables Ph_L to be lower than that before the operation of suppressing the pressure rise is performed. The saturation temperature in the condition for ending the operation is lower than that in the condition for starting the operation. The saturation temperature is approximately 16 to 21 degrees centigrade, which are approximately 10 to 15 degrees centigrade lower than 31 degrees centigrade, which is the critical-point temperature of CO2, and the saturation pressure of CO2 in this case is determined to 5.21 to 5.86 MPa by conversion. Accordingly, the threshold β, which is the difference from the critical-point pressure Pcr, may be approximately 1.5 to 2.2 MPa.

For example, in order to allow heat exchange in the receiver heat exchanging portion 25, it is necessary to have a predetermined difference between the condensing temperature in the low-stage-side refrigerant circuit, this condensing temperature being a higher temperature, and the evaporating temperature in the high-stage-side refrigerant circuit, this evaporating temperature being a lower temperature. At this time, the evaporating temperature in the high-stage-side refrigerant circuit may be preferably 5 to 10 degrees centigrade lower than the condensing temperature in the low-stage-side refrigerant circuit. In step S107, the high-pressure-side pressure Ph_L in the low-stage-side refrigerant circuit immediately before the operation of suppressing the pressure rise in the low-stage-side refrigerant circuit ends is the value obtained by subtracting β from the critical-point pressure Pcr, and the condensing temperature in the low-stage-side refrigerant circuit is the saturation temperature corresponding to the high-pressure-side pressure Ph_L.

As described above, the target low-pressure-side saturation temperature in the high-stage-side refrigerant circuit can be set on the basis of the saturation temperature in the low-stage-side refrigerant circuit set in step S107. For example, a case where the reduced value of the saturation temperature of the low-stage-side refrigerant (CO2) for the high-pressure-side pressure Ph_L at the time the operation of suppressing the pressure rise is ended is set at 21 degrees centigrade, which is 10 degrees centigrade lower than the critical-point temperature 31 degrees centigrade. At this time, the condensing temperature of the low-stage-side refrigerant immediately before the operation actually ends is 21 degrees centigrade. Thus in consideration of the temperature difference in the receiver heat exchanging portion 25, the evaporating temperature in the high-stage-side refrigerant circuit (target low-pressure-side saturation temperature in the high-stage-side refrigerant circuit) can be set at, for example, 16 degrees centigrade, which is 5 degrees centigrade lower than the condensing temperature of the low-stage-side refrigerant.

Here, if the target low-pressure-side saturation temperature is too low, because the power consumption in the high-stage refrigeration cycle 20 is large. Thus more energy-saving operation can be achieved by properly setting the target low-pressure-side saturation temperature. In operation of suppressing the pressure rise, because the outside-air temperature is typically high, the rotation speed of the high-stage-side condenser fan 52 may be preferably, but not limited to, the maximum (top speed). The opening degree of the high-stage-side expansion valve 23 may preferably be adjusted such that the degree of superheat at the refrigerant outlet of the high-stage-side evaporator 24 is a predetermined target value, as in the case of the normal cooling operation.

In Embodiment 1, in steps S102 and S106, the high-pressure-side pressure Ph_L is detected directly. For example, the temperature sensor 63, which is disposed on the low-stage-side receiver 13 and configured to detect a temperature Th_L of the liquid refrigerant on the high-pressure side of the low-stage-side refrigerant circuit, may also be used to detect the high-pressure-side pressure Ph_L. Here, the high-stage refrigeration cycle controller 32 stores data on from the relationship between the saturation pressure and saturation temperature to the relationship between the high-pressure-side pressure Ph_L and the high-pressure liquid refrigerant temperature Th_L in the form of a table in advance. The high-stage refrigeration cycle controller 32, which is estimating and calculating means, is configured to calculate, for estimation, and determine, the pressure of the low-stage-side refrigerant in the low-stage-side refrigerant circuit on the basis of the high-pressure liquid refrigerant temperature Th_L.

If the high-pressure-side pressure Ph_L is larger than the critical-point pressure Pcr, no saturation temperature exists. In such a case, a pseudo-saturation temperature may be used by setting the relationship between pressures and temperature at or above the critical-point temperature. If the temperature sensor 63 is connected to the high-stage refrigeration cycle controller 32, the high-stage refrigeration cycle controller 32 can solely perform the operation of suppressing the pressure rise in the low-stage-side refrigerant circuit. The location of the temperature sensor 63 in the low-stage-side receiver 13 may preferably be close to the bottom as much as possible so as to be in contact with the liquid surface. The temperature sensor 63 may be disposed inside the low-stage-side receiver 13 such that it can directly detect the temperature of the high-pressure liquid refrigerant. This can enable estimating the high-pressure-side pressure Ph_L in the low-stage-side refrigerant circuit on the basis of the temperature of the high-pressure liquid refrigerant in the low-stage-side refrigerant circuit relating to detection by the temperature sensor 63, in place of the pressure sensor 61.

In Embodiment 1, because the low-stage-side refrigerant circuit is cooled in the low-stage-side receiver 13, the low-stage-side liquid refrigerant produced by the cooling can be stored in the low-stage-side receiver 13 any time. Accordingly, the low-stage-side refrigerant circuit can be cooled more effectively. Because the low-stage-side receiver 13 stores a large amount of the low-stage-side refrigerant, cooling the low-stage-side receiver 13 is effective at suppressing the pressure rise in the low-stage-side refrigerant circuit.

In Embodiment 1, the receiver heat exchanging portion 25 is disposed between the high-stage-side expansion valve 23 and high-stage-side evaporator 24 in the low-stage-side refrigerant circuit. For example, the receiver heat exchanging portion 25 may be disposed between the high-stage-side evaporator 24 and high-stage-side compressor 21.

In Embodiment 1, the three controllers consisting of the low-stage refrigeration cycle controller 31, high-stage refrigeration cycle controller 32, and indoor-unit controller 33 are included. This is a particularly suited example. Depending on the case, one or two controllers may be included. Even in that case, when the high-stage refrigeration cycle 20 can solely perform the operation of cooling the low-stage-side receiver 13 during the operation of suppressing the pressure rise in the low-stage-side refrigerant circuit, the low-stage-side receiver 13 can be cooled more reliably.

Embodiment 2

In Embodiment 1 described above, the high-stage-side refrigerant flows in the receiver heat exchanging portion 25 in both the normal cooling operation and the operation of suppressing the pressure rise in the low-stage-side refrigerant circuit. Next, Embodiment 2, in which the high-stage-side refrigerant flows in the receiver heat exchanging portion 25 in the operation of suppressing the pressure rise in the low-stage-side refrigerant circuit, is described. Here, for example, the equipment and the like described in Embodiment 1 perform substantially the same action and the like as in Embodiment 1.

Figure 4:
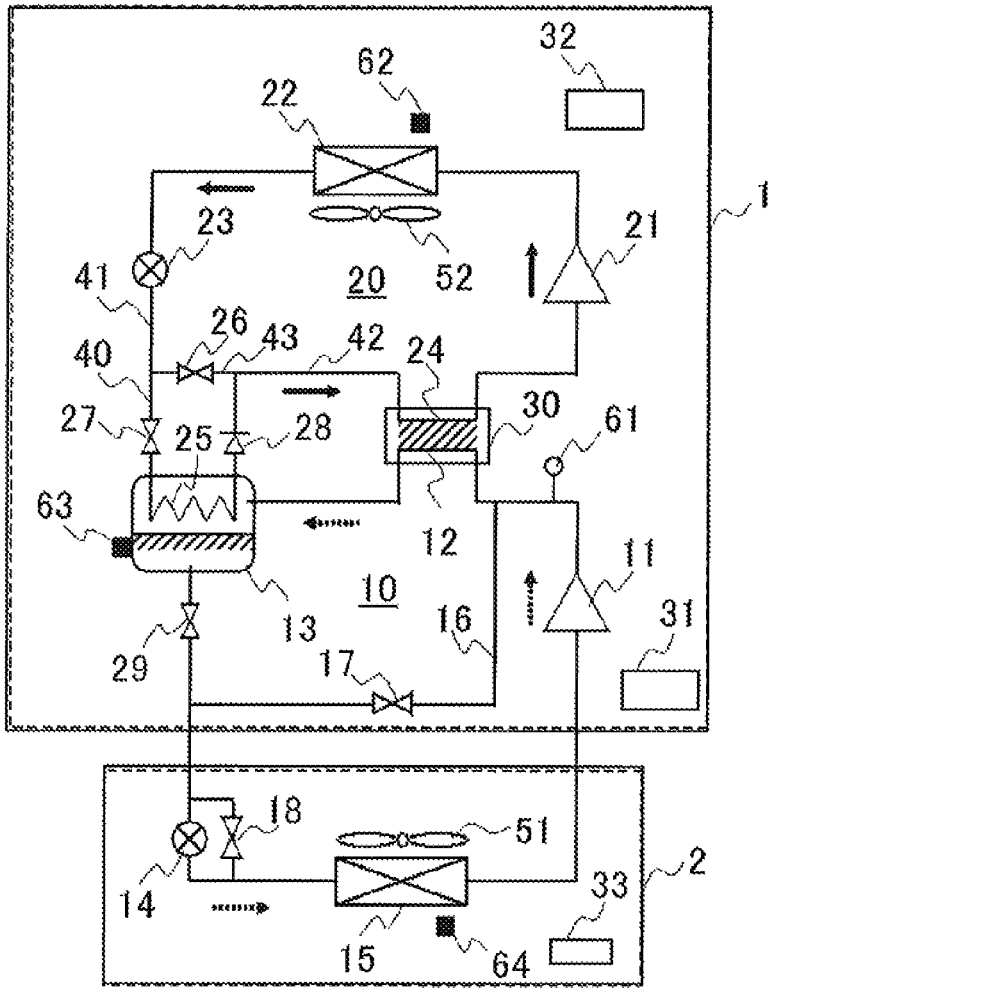
FIG. 4 illustrates a configuration of a two-stage refrigeration apparatus of Embodiment 2 of the present invention.

FIG. 4 illustrates a configuration of a two-stage refrigeration apparatus according to Embodiment 2 of the present invention. In the two-stage refrigeration apparatus of Embodiment 2, the high-stage refrigeration cycle 20 includes a receiver heat exchange circuit 40. The receiver heat exchange circuit 40 includes a heat-exchanging-portion inlet valve 27, a heat-exchanging-portion bypass valve 26, a check valve 28, and a heat-exchanging-portion bypass pipe 43. One example of the heat-exchanging-portion inlet valve 27 may be a solenoid valve. The heat-exchanging-portion inlet valve 27 is a valve controlling the passage of the high-stage-side refrigerant to the receiver heat exchanging portion 25. The heat-exchanging-portion bypass pipe 43 has a first end connected to an outlet pipe 41 for the high-stage-side expansion valve 23 and a second end connected to an inlet pipe 42 for the high-stage-side evaporator 24. One example of the heat-exchanging-portion bypass valve 26 may be a solenoid valve. The heat-exchanging-portion bypass valve 26 is a valve controlling the passage of the high-stage-side refrigerant to the heat-exchanging-portion bypass pipe 43. The check valve 28 is a valve that permits the refrigerant from the receiver heat exchanging portion 25 to flow only to the direction to the inlet pipe 42. Here, in the present invention, the heat-exchanging-portion inlet valve 27 and check valve 28 correspond to "receiver heat-exchanging-portion opening and closing device," the heat-exchanging-portion bypass pipe 43 corresponds to "heat-exchanging-portion bypass portion," and the heat-exchanging-portion bypass valve 26 corresponds to "heat-exchanging-portion bypass opening and closing device."

Figure 5:
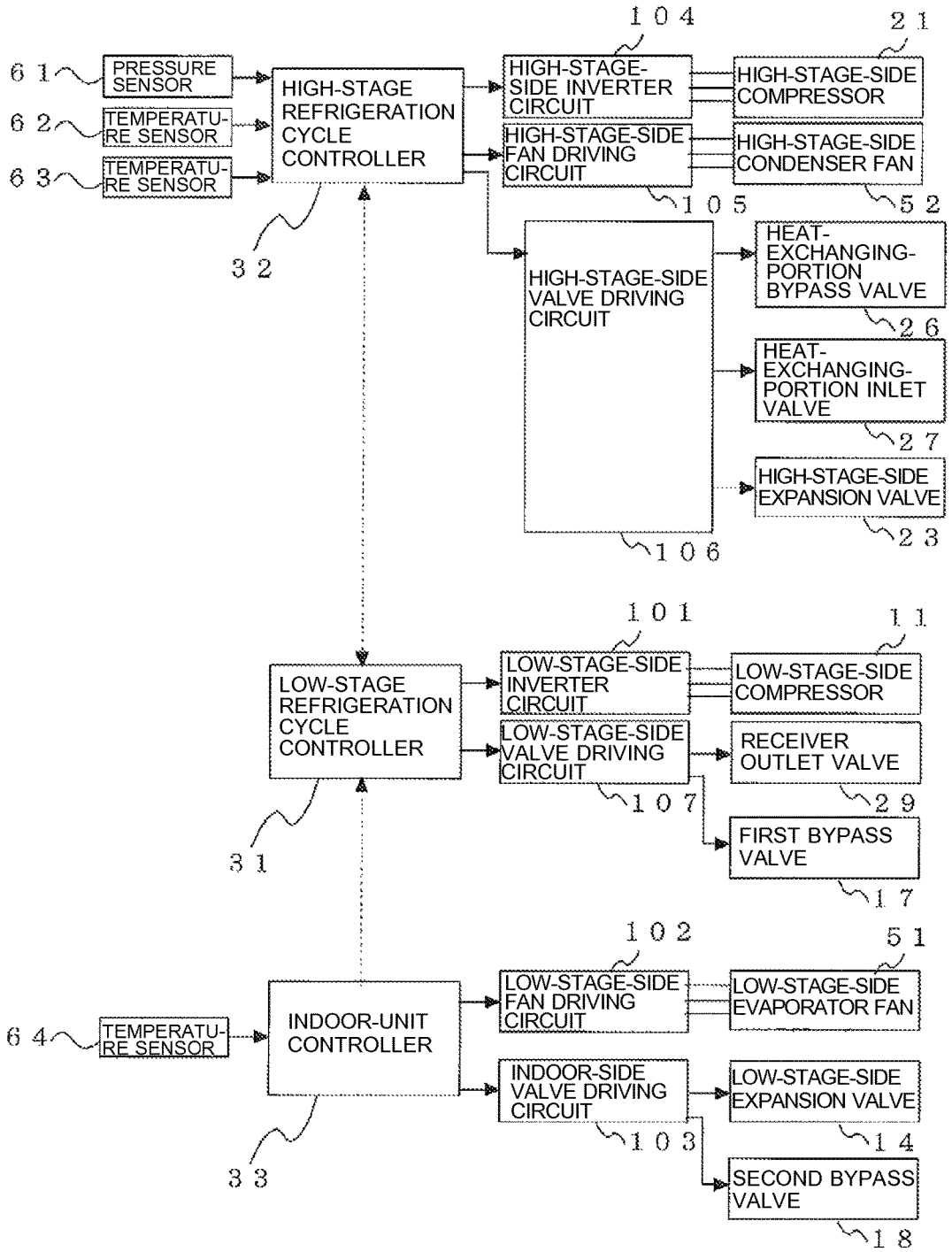
FIG. 5 illustrates a configuration of a control system in the two-stage refrigeration apparatus of Embodiment 2 of the present invention.

FIG. 5 illustrates a configuration of a control system in the two-stage refrigeration apparatus of Embodiment 2 of the present invention. The high-stage-side valve driving circuit 106 in Embodiment 2 controls the opening and closing of the heat-exchanging-portion bypass valve 26 and the opening and closing of the heat-exchanging-portion inlet valve 27 in accordance with an instruction from the high-stage refrigeration cycle controller 32. Here, in normal cooling operation, the high-stage refrigeration cycle controller 32 performs controlling such that the heat-exchanging-portion bypass valve 26 is opened and the heat-exchanging-portion inlet valve 27 is closed.

(Action of High-Stage Refrigeration Cycle 20 in Normal Cooling Operation)

The refrigerant decompressed by the high-stage-side expansion valve 23 passes through the heat-exchanging-portion bypass valve 26 and flows into the high-stage-side evaporator 24 (cascade condenser 30). At this time, the heat-exchanging-portion inlet valve 27 is closed. In addition, because the check valve 28 is disposed between the receiver heat exchanging portion 25 and the inlet pipe 42 for the high-stage-side evaporator 24, the refrigerant in the high-stage-side refrigerant circuit does not flow into the receiver heat exchanging portion 25 during normal cooling operation. Accordingly, the high-stage-side refrigerant is evaporated and gasified by the high-stage-side evaporator 24 alone.

(Method for Operation of Suppressing Pressure Rise in Low-Stage-Side Refrigerant Circuit)

Figure 6:
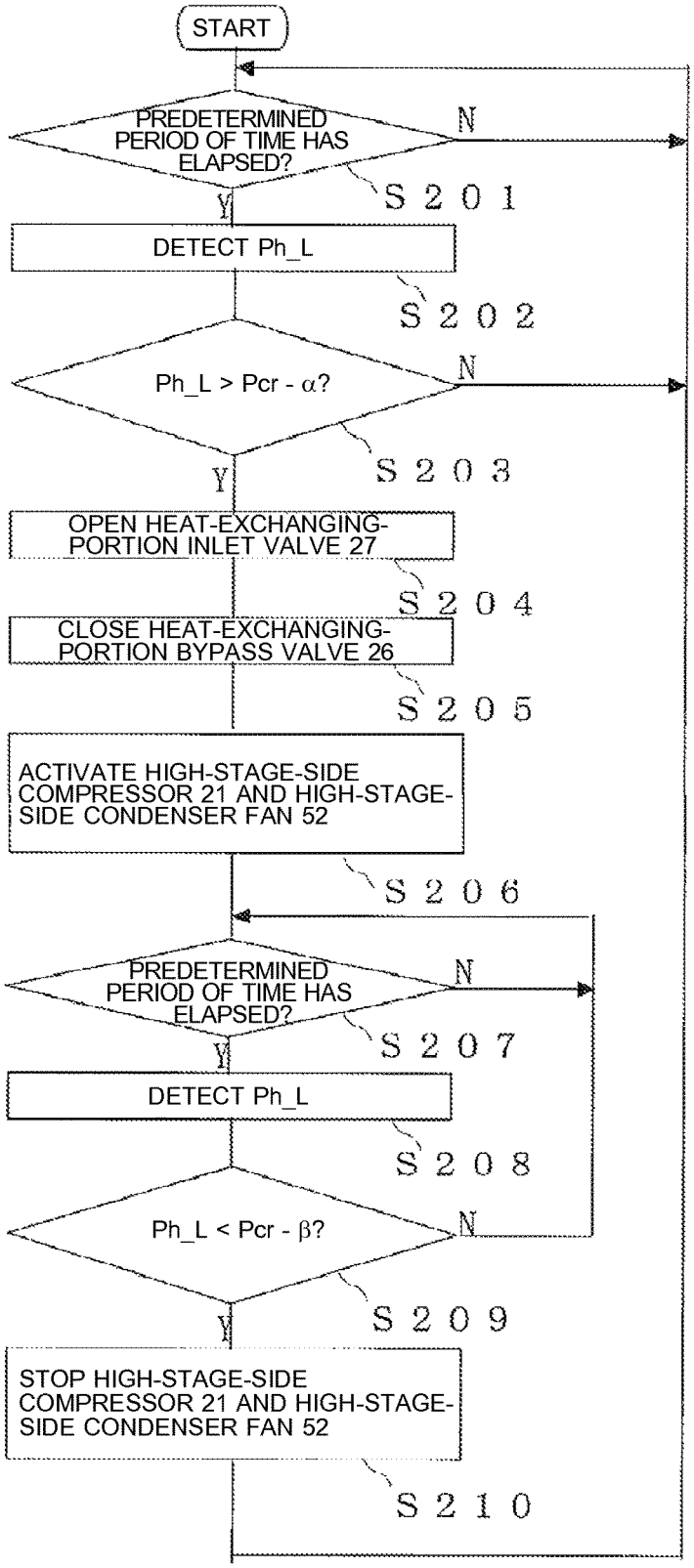
FIG. 6 is a flowchart of a process for suppressing a pressure rise in a low-stage-side refrigerant circuit in Embodiment 2 of the present invention.

FIG. 6 is a flowchart of a pressure adjusting process in the low-stage-side refrigerant circuit in Embodiment 2 of the present invention. When the low-stage-side compressor 11 stops, the high-stage refrigeration cycle controller 32 starts this process, and the process continues while the low-stage-side compressor 11 is inactive.

The high-stage refrigeration cycle controller 32 determines whether a predetermined period of time has elapsed since the start of the process (step S201). When the high-stage refrigeration cycle controller 32 determines that the predetermined period of time has elapsed (YES), it acquires (determines) the high-pressure-side pressure Ph_L in the low-stage-side refrigerant circuit relating to detection by the pressure sensor 61 (step S202). One example of the predetermined period of time may be approximately one minute, as in the case of Embodiment 1. The high-stage refrigeration cycle controller 32 determines whether the high-pressure-side pressure Ph_L in the low-stage-side refrigerant circuit is larger than a value obtained by subtracting the threshold $\alpha$ from the critical-point pressure Pcr of $CO_2$ (step S203).

When the high-stage refrigeration cycle controller 32 determines that Ph_L is not larger (NO), the process returns to step S201 and continues.

In contrast, when the high-stage refrigeration cycle controller 32 determines that Ph_L is larger (YES), it opens the heat-exchanging-portion inlet valve 27 (step S204) and closes the heat-exchanging-portion bypass valve 26 (step S205).

The high-stage refrigeration cycle controller 32 activates the high-stage-side compressor 21 and high-stage-side condenser fan 52 (step S206).

The high-stage refrigeration cycle controller 32 determines whether a predetermined period of time has elapsed (step S207). When the high-stage refrigeration cycle controller 32 determines that the predetermined period of time has elapsed (YES), it acquires (determines) the high-pressure-side pressure Ph_L in the low-stage-side refrigerant circuit relating to detection by the pressure sensor 61 again (step S208). The predetermined period of time may be preferably approximately one minute, as in the case of Embodiment 1.

The high-stage refrigeration cycle controller 32 determines whether the high-pressure-side pressure Ph_L in the low-stage-side refrigerant circuit is smaller than a value obtained by subtracting the threshold β from the critical-point pressure Pcr of CO2 (step S209). When the high-stage refrigeration cycle controller 32 determines that Ph_L is smaller (YES), it stops the high-stage-side compressor 21 and high-stage-side condenser fan 52 (step S210), closes the heat-exchanging-portion inlet valve 27 (step S211), and opens the heat-exchanging-portion bypass valve 26 (step S212). The process returns to step S201 and continues. In contrast, when the high-stage refrigeration cycle controller 32 determines that Ph_L is not smaller (NO), the process returns to step S207 and continues.

In the two-stage refrigeration apparatus of Embodiment 2, in the high-stage-side refrigerant circuit, during normal cooling operation, the high-temperature-side refrigerant bypasses the receiver heat exchanging portion 25 and flows into the heat-exchanging-portion bypass pipe 43. In operation of suppressing the pressure rise in the low-stage-side refrigerant circuit, the low-stage-side refrigerant in the low-stage-side receiver 13 is cooled in the receiver heat exchanging portion 25.

For example, during normal cooling operation, in a case where the cooling load for the low-stage-side evaporator 15 is small, or the like, if the low-stage-side receiver 13 is cooled in the receiver heat exchanging portion 25, the low-stage-side refrigerant in the low-stage-side refrigerant circuit is too condensed in the low-stage-side receiver 13 and a large amount of the liquid refrigerant is stored. Thus there is a possibility that the high-pressure-side pressure in the low-stage-side refrigerant circuit does not rise to a proper value and the coefficient of performance (COP) in the two-stage refrigeration apparatus decreases. To address this issue, the low-stage-side refrigerant in the low-stage-side receiver 13 is cooled in the receiver heat exchanging portion 25 only during the operation of suppressing the pressure rise in the low-stage-side refrigerant circuit. This can prevent a decrease in COP in normal cooling operation and can improve the reliability while the low-stage refrigeration cycle 10 is inactive.

In Embodiment 2, the heat-exchanging-portion inlet valve 27 is disposed on the refrigerant inlet side of the receiver heat exchanging portion 25, and the check valve 28 is disposed on the refrigerant outlet side thereof. Disposing the valves on both of the inlet and outlet sides and controlling the streams can prevent refrigerating machine oil in the high-stage-side refrigerant circuit from remaining in the receiver heat exchanging portion 25, for example. The valves may not be disposed on both sides. A device for controlling a refrigerant stream, such as an opening and closing device, may be disposed on only either one of the inlet and outlet sides.

Here, in Embodiment 2, the heat-exchanging-portion bypass valve 26 is disposed. During the operation of suppressing the pressure rise in the low-stage-side refrigerant circuit, the high-temperature-side refrigerant is prevented from flowing into the heat-exchanging-portion bypass pipe 43 by closing the heat-exchanging-portion bypass valve 26. Thus the high-stage-side refrigerant can be caused to fully run through the receiver heat exchanging portion 25, and the advantage of cooling the refrigerant in the low-stage-side refrigerant circuit can be more enhanced. However, Embodiment 2 is not limited to this configuration. Even without the heat-exchanging-portion bypass valve 26, the high-temperature-side refrigerant can be caused to flow into the receiver heat exchanging portion 25 by opening the heat-exchanging-portion inlet valve 27, and thus the low-stage-side refrigerant can be cooled. Although not particularly described in the above-described process, for example, when the high-stage-side compressor 21 and high-stage-side condenser fan 52 are stopped in step S210, the heat-exchanging-portion inlet valve 27 may be closed and the heat-exchanging-portion bypass valve 26 may be opened (if this closing and opening is not performed in the process, the heat-exchanging-portion inlet valve 27 is closed and the heat-exchanging-portion bypass valve 26 is opened when the operation is switched to the normal cooling operation, for example).

Embodiment 3

In Embodiment 1 and Embodiment 2 described above, during hot-gas defrosting of causing the high-temperature low-stage-side refrigerant exiting from the low-stage-side compressor 11 to flow into the low-stage-side evaporator 15, a rise in the low-stage-side refrigerant circuit is suppressed. Next, Embodiment 3, in which heating means, such as an electric heater, is included near the low-stage-side evaporator 15 and frost in the low-stage-side evaporator 15 is melted by being heated by the heating means, is described.

Figure 7:
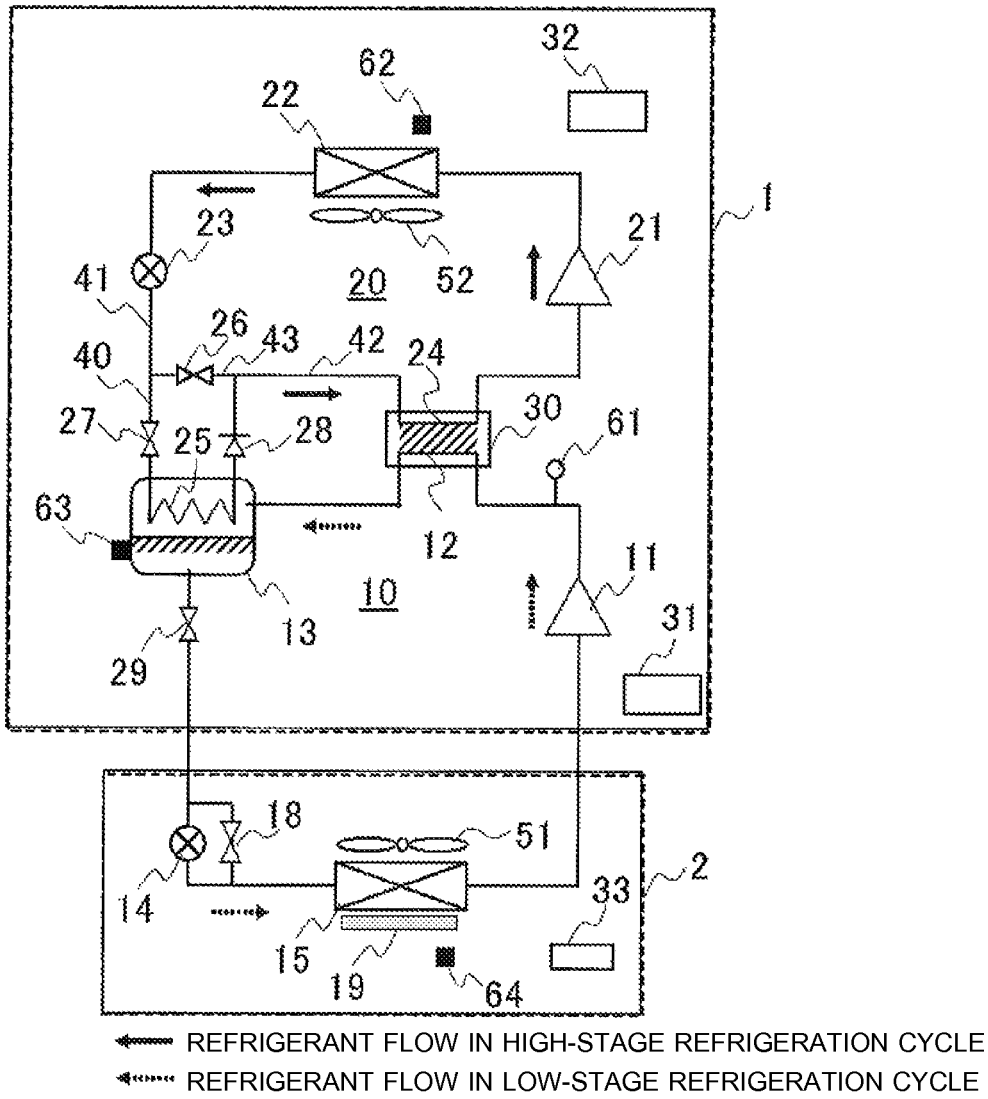
FIG. 7 illustrates a configuration of a two-stage refrigeration apparatus of Embodiment 3 of the present invention.

FIG. 7 illustrates a configuration of a two-stage refrigeration apparatus of Embodiment 3 of the present invention. In FIG. 7, the equipment and the like having the same reference numerals as in FIG. 1 and the like perform substantially the same action as that described in Embodiment 1 and the like. The two-stage refrigeration apparatus of Embodiment 3 includes an electrical heater 19 near the low-stage-side evaporator 15. In Embodiment 3, at the time the defrosting operation for the low-stage-side evaporator 15 starts, the low-stage-side compressor 11 and high-stage-side compressor 21 are stopped, and the receiver outlet valve 29 is closed. After that, current is applied to the electrical heater 19 to cause heating, the surface of the low-stage-side evaporator 15 is heated, and the frost is melted.

In Embodiment 3, because the low-stage-side evaporator 15 is heated by the electrical heater 19, a temperature rise occurs in the low-stage-side refrigerant in the low-stage-side refrigerant circuit. Accordingly, in a case where the amount of heating of the low-stage-side evaporator 15 is large and the ambient temperatures of the outdoor unit 1 and indoor unit 2 are high, there is a possibility that the pressure of the low-stage-side refrigerant is high. When it is estimated that the high-pressure-side pressure in the low-stage-side refrigerant circuit will reach the critical-point pressure, the high-stage refrigeration cycle 20 is operated and the low-stage-side receiver 13 is cooled by the receiver heat exchanging portion 25, which is the low-pressure-side portion in the high-stage-side refrigerant circuit, thus enabling the pressure rise occurring with the temperature rise in the low-stage-side refrigerant circuit to be suppressed.

In Embodiment 3, the low-pressure side of the low-stage-side refrigerant circuit is heated by the electrical heater 19 in the indoor unit 2, whereas cooling for suppressing the pressure rise is performed on the high-pressure side of the low-stage-side refrigerant circuit in the outdoor unit 1. As previously described, during defrosting, where the low-stage-side compressor 11 is inactive, because the compressor used in the refrigerating machine includes a check valve (not illustrated) for permitting the stream only to the direction in which the refrigerant is discharged, when a pressure rise occurs on the low-pressure side of the low-stage-side refrigerant circuit, the refrigerant moves to the high-pressure side. Accordingly, as in Embodiment 3, the pressure rise of the low-temperature-side refrigerant on the high-pressure side of the low-stage-side refrigerant circuit may be detected and the above-described cooling operation may be performed. During defrosting, the liquid refrigerant is prevented from flowing to the low-pressure side of the low-stage-side refrigerant circuit by closing the receiver outlet valve 29, and in cooling the low-stage-side receiver 13, the liquid refrigerant can be stored in the low-stage-side receiver 13 more effectively.

INDUSTRIAL APPLICABILITY

The two-stage refrigeration apparatus of the present invention is widely applicable to a showcase, a refrigerator-freezer for business use, refrigerating equipment in a vending machine, and the like, which require using a non-CFC refrigerant, reducing CFC refrigerants, and saving energy in the equipment.

REFERENCE SIGNS LIST

1 outdoor unit
2 indoor unit
10 low-stage refrigeration cycle
11 low-stage-side compressor
12 low-stage-side condenser
13 low-stage-side receiver
14 low-stage-side expansion valve
15 low-stage-side evaporator
16 bypass
17 first bypass valve
18 second bypass valve
19 electrical heater
20 high-stage refrigeration cycle
21 high-stage-side compressor
22 high-stage-side condenser
23 high-stage-side expansion valve
24 high-stage-side evaporator
25 receiver heat exchanging portion
26 heat-exchanging-portion bypass valve
27 heat-exchanging-portion inlet valve
28 check valve
29 receiver outlet valve
30 cascade condenser
31 low-stage refrigeration cycle controller
32 high-stage refrigeration cycle controller
33 indoor-unit controller
40 receiver heat exchange circuit
41 outlet pipe
42 inlet pipe
43 heat-exchanging-portion bypass pipe
51 low-stage-side evaporator fan
52 high-stage-side condenser fan
61 pressure sensor
62, 63, 64 temperature sensor
101 low-stage-side inverter circuit
102 low-stage-side fan driving circuit
103 indoor-side valve driving circuit
104 high-stage-side inverter circuit
105 high-stage-side fan driving circuit
106 high-stage-side valve driving circuit
107 low-stage-side valve driving circuit.

The invention claimed is:

1. A two-stage refrigeration apparatus comprising:

a first refrigeration cycle device including a first refrigerant circuit in which a first compressor, a first condenser, a first expansion device, and a first evaporator are connected by pipes, the first refrigerant circuit circulating a first refrigerant;

a second refrigeration cycle device including a second refrigerant circuit in which a second compressor, a second condenser, a receiver, a second expansion device, and a second evaporator are connected by pipes, the second refrigerant circuit circulating a second refrigerant, the receiver being disposed between the second condenser and the second expansion device and being configured to store liquid refrigerant;

a cascade condenser including the first evaporator and the second condenser and configured to cause the first refrigerant flowing in the first evaporator and the second refrigerant flowing in the second condenser to exchange heat with each other;

a receiver heat exchanging portion configured to cool the refrigerant stored in the receiver by heat exchange with a portion in which the first refrigerant being low-pressure flows in the first refrigerant circuit, the receiver heat exchanging portion being integrally provided with the receiver;

a heat-exchanging-portion bypass portion for bypassing the receiver heat exchanging portion in the first refrigerant circuit;

a receiver heat-exchanging-portion opening and closing device configured to control passage of the refrigerant through the receiver heat exchanging portion;

a defrosting unit configured to defrost the second evaporator; and a controller configured to perform controlling so as to activate the first compressor and so as to open the receiver heat-exchanging-portion opening and closing device on the basis of the pressure of the second refrigerant to prevent the second refrigerant within the receiver from reaching a supercritical state while the second evaporator is being defrosted by the defrosting unit.

2. The two-stage refrigeration apparatus of claim 1, further comprising:

a pressure determining unit configured to determine a pressure of the second refrigerant in the second refrigerant circuit, wherein the pressure determining unit includes a pressure detecting device disposed between a discharge side of the second compressor and a refrigerant inlet side of the second expansion device in the second refrigerant circuit and configured to detect the pressure of the second refrigerant on a high-pressure side of the second refrigerant circuit.

3. The two-stage refrigeration apparatus of claim 1, further comprising:

a pressure determining unit configured to determine a pressure of the second refrigerant in the second refrigerant circuit, wherein the pressure determining unit includes a liquid-refrigerant temperature detecting device configured to detect a temperature of the refrigerant in a liquid state on a high-pressure side of the second refrigerant circuit, and a calculating unit configured to calculate the pressure of the second refrigerant on the basis of the temperature relating to the detection by the liquid-refrigerant temperature detecting device.

4. The two-stage refrigeration apparatus of claim 1, wherein the second refrigerant circuit further includes a bypass comprising a pipe that has a first end connected to a refrigerant pipe that extends between the second compressor and the second condenser and a second end connected to a refrigerant pipe that extends between the receiver and the second evaporator, and the defrosting unit is hot gas being a low-stage-side refrigerant caused to pass through the bypass and flow into the second evaporator by driving of the second compressor.

5. The two-stage refrigeration apparatus of claim 1, wherein the defrosting unit is an electrical heater disposed on the second evaporator.

6. The two-stage refrigeration apparatus of claim 1, further comprising a heat-exchanging-portion bypass opening and closing device disposed on the heat exchanging-portion bypass portion, and the controller closes the heat-exchanging-portion bypass opening and closing device in cooling the second refrigerant in the receiver heat exchanging portion.

7. The two-stage refrigeration apparatus of claim 1, wherein the second refrigerant is carbon dioxide.

8. The two-stage refrigeration apparatus of claim 1, wherein the receiver heat exchanging portion comprises a refrigerant pipe disposed inside the receiver.

* * * * *